US006488125B1

(12) United States Patent
Otsuka et al.

(10) Patent No.: US 6,488,125 B1
(45) Date of Patent: Dec. 3, 2002

(54) TRACTION ELEVATOR

(75) Inventors: Motoharu Otsuka; Hidehiko Kobayashi, both of Kanagawa-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/248,313

(22) Filed: Feb. 11, 1999

(30) Foreign Application Priority Data

Mar. 12, 1998 (JP) ..... 10-061194

(51) Int. Cl.[7] ..... B66B 11/08

(52) U.S. Cl. ..... 187/264; 187/254; 187/266; 187/414

(58) Field of Search ..... 187/294, 251, 187/256, 264, 266, 405, 414

(56) References Cited

U.S. PATENT DOCUMENTS

| | | | | |
|---|---|---|---|---|
| 2,537,075 A | * | 1/1951 | Margles | |
| 3,810,529 A | * | 5/1974 | Tosato et al. | 187/404 |
| 3,882,968 A | * | 5/1975 | Suozzo | 187/404 |
| 5,103,937 A | * | 4/1992 | Robertson | 187/254 |

FOREIGN PATENT DOCUMENTS

| | | | |
|---|---|---|---|
| JP | 351112048 | * 10/1976 | |
| JP | 1-118967 | 8/1989 | |
| JP | 404217579 | * 8/1992 | |
| JP | 5-178564 | * 7/1993 | 187/414 |
| JP | 406064863 | * 3/1994 | |
| JP | 406211463 | * 8/1994 | |
| JP | 9-315728 | 12/1997 | |

OTHER PUBLICATIONS

Derwent English Abstract for Japanese Patent JP2000034073A, Feb. 2000.*

English Abstract, Japanese Patent JP353043346A, Apr. 1978.*

US Statutory Invention Registration, H702, whole document, Nov. 1989.*

* cited by examiner

*Primary Examiner*—Robert P. Olszewski
*Assistant Examiner*—Steven B. McAllister
(74) *Attorney, Agent, or Firm*—Oblon, Spivak, McClelland, Maier & Neustadt, P.C.

(57) ABSTRACT

An elevator has a rope connected at a first end thereof to a top of a car and at a second end thereof to a top of a counterweight and guided and driven by a sheave that is rotated by a motor. A compensating rope suspends between the car and the counterweight. The compensating rope has a curving portion, a first linear portion on the car side of the curving portion, and a second linear portion on the counterweight side of the curving portion for compensating an imbalance of weight between a portion of the rope on the car side of the sheave and a portion of the rope on the counterweight side of the sheave. A first guide is arranged to guide the first linear portion and the second linear portion, and a second guide is arranged below the first guide and positioned between lines extending from the first linear portion and the second linear portion for guiding the curving portion of the compensating rope. A frame is arranged in a pit of an elevator shaft for supporting the first guide and the second guide.

11 Claims, 9 Drawing Sheets

TRACTION ELEVATOR

BACKGROUND OF THE INVENTION

1. Field of the Invention

The present invention relates to a traction elevator having a compensating rope guide, and more particularly to a traction elevator that can reduce the swing of the compensating rope so as to stop the emission of unpleasant noise and vibration of an elevator car, and thus increase the comfort of the ride in the car.

2. Discription of the Related Art

FIG. 11(*a*) is a side view of an ordinary type of widely used traction elevator. In the traction elevator, three ropes 3 (only one is shown) are attached at a first end thereof to a top of a the car 1, and at a second end thereof to a top of a counterweight 2. The ropes 3 are guided by a deflector sheave 6*a* and a sheave 6 driven by a motor in a machine room 5 located over an elevator shaft 4. Friction between the ropes 3 and sheave 6 raises and lowers the car 1 in order to carry passengers and freight.

However, in a traction elevator operating in a very tall shaft, if there is an imbalance of weight between a portion of ropes 3 on the car 1 side of sheave 6 and a portion of the ropes 3 on the counterweight 2 side of sheave 6, the ropes 3 might slip on the sheave 6. Therefore, in the traction elevator operating in a tall shaft, as shown in FIG. 11(*b*), a compensating rope 7 is usually attached at a first end thereof to the bottom of the car 1, and at a second end thereof to the bottom of the counterweight 2.

Then, this kind of the compensating rope 7 can be roughly classified into three types.

First, as shown in FIG. 12(*b*), a wire rope 10 such as the rope 3 is used as the compensating rope 7. Second, as shown in FIG. 12(*c*), a chain 8 made of steel is in use as the compensating rope 7. Third, as shown in FIG. 12(*a*), a coated chain 13 composed of the chain 8 covered with coating 9 such as resin is also used as the compensating rope 7.

In the following description, the wire rope 10, the chain 8 and the coated chain 13 are referred to generically as the compensating rope 7.

As shown in FIG. 12(*b*), the wire rope 10 is generally used in a high-speed elevator, and a tension pulley 11 is usually attached at the curving portion of the wire rope 10 to tension the wire rope 10. Accordingly, the tension pulley 11 lowers the vibration of the wire rope 10 and puts the wire rope 10 in orbit.

The chain 8 is usually used in a relatively low-speed elevator. As shown in FIG. 12(*c*), this type of the chain 8 can omit the tension pulley 11 attached at the curving portion of the wire rope 10 in FIG. 12(*b*), and thus reduce the cost of equipment, because the chain 8 does not swing as easily as the wire rope 10 when hanging with the tension of its own weight.

However, if the chain 8 is used in a high-speed elevator, the chain 8 makes noise and swings more than the wire rope 10 in a condition of hanging with the tension of the weight of the tension pulley 11 in FIG. 12(*b*). Although the chain 8 does not swing as easily as the wire rope 10 when hanging with the tension of its own weight, the chain 8 is not available in the high-speed elevator.

In recent years, the coated chain 13 compromising the wire rope 10 and the chain 8 has been adopted.

As shown in FIG. 12(*d*), the coated chain 13 includes the chain 8 covered with the coating 9 that reduces noise.

Further, guides composed of small rollers 14 are arranged above the curving portion of the coated chain 13 in order to reduce the swing of the coated chain 13. Therefore, the coated chain 13 can be adopted for a high-speed elevator.

However, as shown in FIG. 13, when a building with an elevator sways due to a sudden gust of wind or an earthquake, the coated chain 13 swings and the n se ems to shift over the rollers 14 at the downward side of the guides. On the other hand, at the upward side of the guides, the coated chain 13 is pulled by the car 1 or the counterweight 2 and goes up as it is. Accordingly, the coated chain 13 is strongly pressed against the rollers 14 and an angle bracket (not shown) supporting the rollers 14 at an acute angle, and then the coated chain 13 em its unpleasant noise due to resistance between the coated chain 13 and the rollers 14. Further, since the coated chain 13 is caught in a corner of the rollers 14, a rotation of the rollers 14 becomes difficult. As a result, the car 1 begins to vibrate, and the vibration may negatively influence the comfort of the ride in the car 1.

SUMMARY OF THE INVENTION

Accordingly, one object of this invention is to provide a traction elevator having a compensating rope guide which can reduce the swing of a compensating rope so as to stop the emission of unpleasant noise and vibration of an elevator car, and thus avoid negatively influencing the comfort of the ride in the car.

The object of this invention can be achieved by providing an elevator having a rope connected at the first end thereof to the top of a car and at the. second end thereof to the top of a counterweight, and guided and driven by a sheave which is rotated by a motor, composed of a compensating rope suspended from the car to the counterweight, the compensating rope having a curving portion, a first linear portion on the car side of the curving portion and a second linear portion on the counterweight side of the curving portion for compensating an imbalance of weight between a portion of the rope on the car side of the sheave and a portion of the rope on the counterweight side of the sheave. A first guide is arranged to guide the first linear portion and the second linear portion. A second guide is arranged below the first guide and positioned between the extended lines of the first linear portion of the compensating rope and the second linear portion of the compensating rope for guiding. the curving portion of the compensating rope. A frame is arranged in the pit of an elevator shaft for supporting the first guide and the second guide.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1(*b*) is atop view taken along line A—A in FIG. 1(*a*);

FIG. 10(*b*) is a cross-sectional view of the rotatable m ember in FIG. 10(*a*);

DETAILED DESCRIPTION OF THE PREFERRED EMBODIMENTS

Figure 1A:
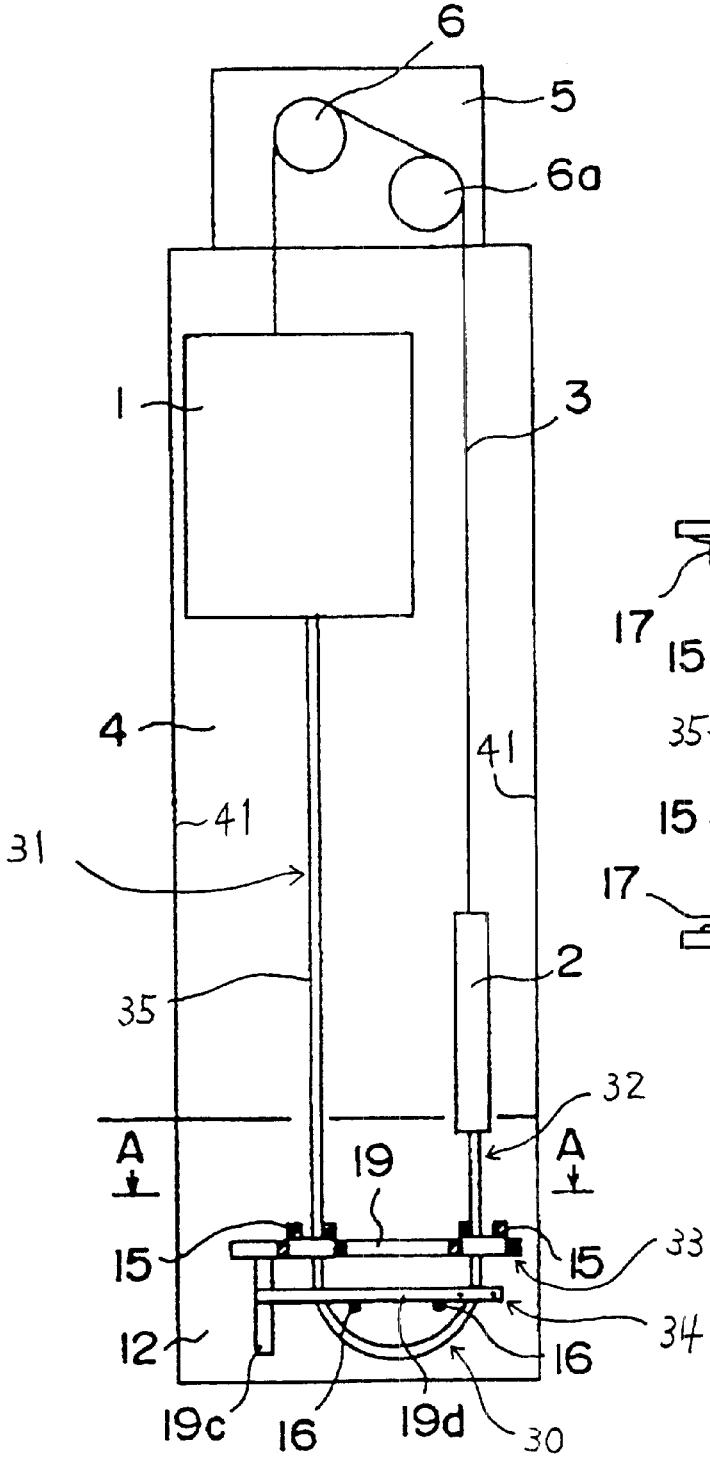
FIG. 1(*a*) is a side view showing a shaft of a traction elevator having a compensating rope guide of a first embodiment of the present invention.

Referring now to the drawings, wherein like reference numerals designate identical or corresponding parts throughout the several views, the embodiments of the present invention are described below.

Figure 1B:
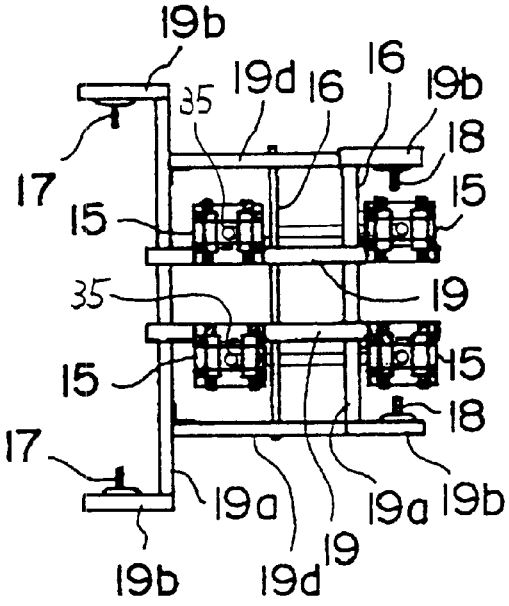

FIG. 1(*a*) is a side view showing the construction of a shaft of a traction elevator having a compensating rope guide of a first embodiment of the present invention. FIG. 1(*b*) is a view in the direction of an arrow A—A in FIG. 1(*a*).

Figure 12:
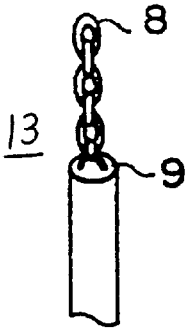
FIG. 12 (a) (PRIOR ART)
FIGS. 12(*a*) 12(*b*), 12(*c*) and 12(*d*) show various compensating rope designs.
Figure 12:
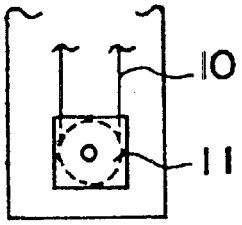
FIG. 12 (b) (PRIOR ART)
Figure 12:
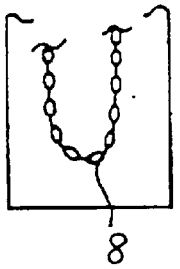
FIG. 12 (c) (PRIOR ART)
Figure 12:
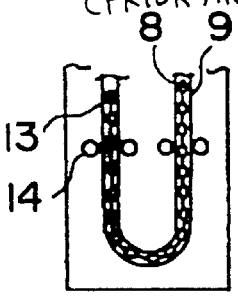
FIG. 12 (d) (PRIOR ART)
Figure 13:
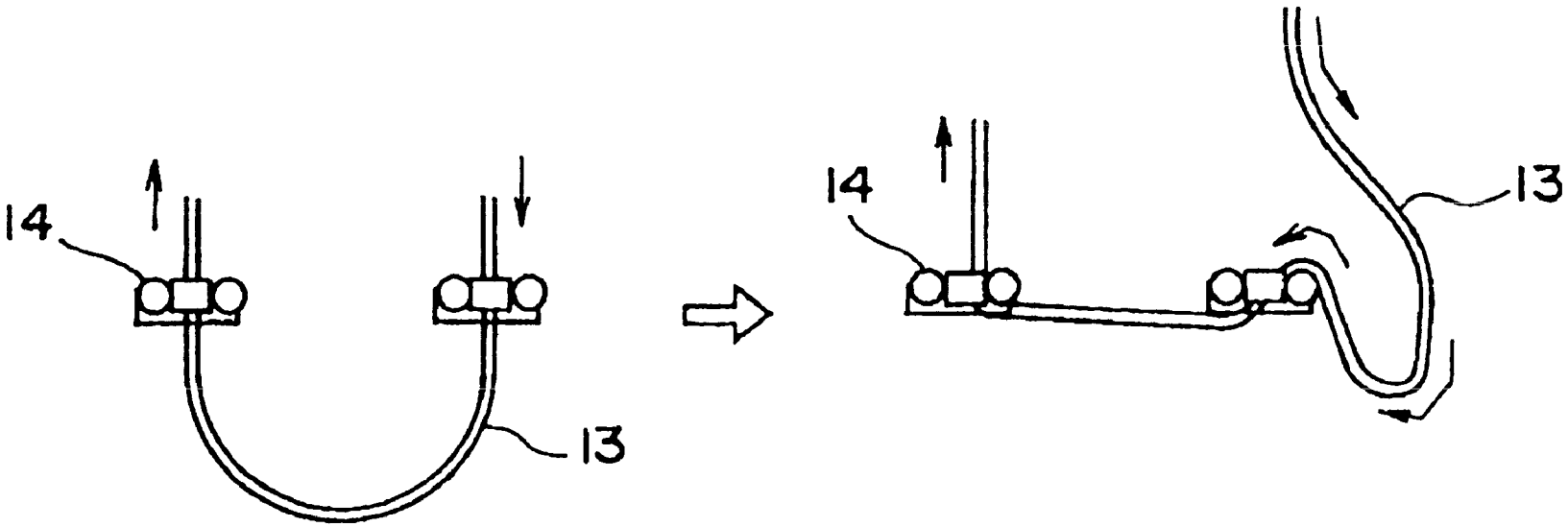
FIG. 13 (PRIOR ART)
FIG. 13 is an illustrative diagram showing an example of the operation of compensating rope.

As shown in FIGS. 1(*a*) and 1(*b*), in this embodiment, three ropes 3 (only one is shown) are attached at a first end thereof to a top of a the car 1 and at a second end thereof to a top of a counterweight 2. The ropes 3 are guided by a deflector sheave 6*a* and a sheave 6 driven by a motor in a machine room 5 located over an elevator shaft 4. Two compensating ropes 35 are suspended from the car 1 to the counterweight 2. Each of the compensating ropes 35 has a curving portion 30, a first linear portion 31 on the car 1 side of the curving portion 30 and a second linear portion 32 on the counterweight 2 side of the curving portion 30 for compensating an imbalance of weight between the portion of the ropes 3 on the car 1 side of the sheave 6 and the portion of the ropes 3 on the counterweight side of the sheave 6. A first guide 33 is arranged in a pit 12 located below the lowest floor for guiding the first linear portions 31 and the second linear portions 32 in the pit 12. A second guide 34 is arranged below the first guide 33 and positioned between the extended lines of the first linear portions 31 of the compensating ropes 35 and the second linear portions 32 of the compensating ropes 35 for guiding the curving portions 30 of the compensating ropes 35. The compensating ropes 35 such as the coated chain 13 in FIG. 12(*d*) are guided by the first guide 33 and the second guide 34.

The first guide 33 and the second guide 34 are supported by a frame 19 fixed to a pair of car guide rails 17 for guiding the car 1 and a pair of counterweight guide rails 18 for guiding the counterweight 2. The frame 19 is composed of brackets 19*a*, 19*b*, 19*c* and 19*d*. Further, the first guide 33 is composed of four rotatable members 15 so that the compensating ropes 35 are directed in the moving directions of the compensating ropes 35. Furthermore, the second guide 34 is composed of two bars 16.

Figure 2:
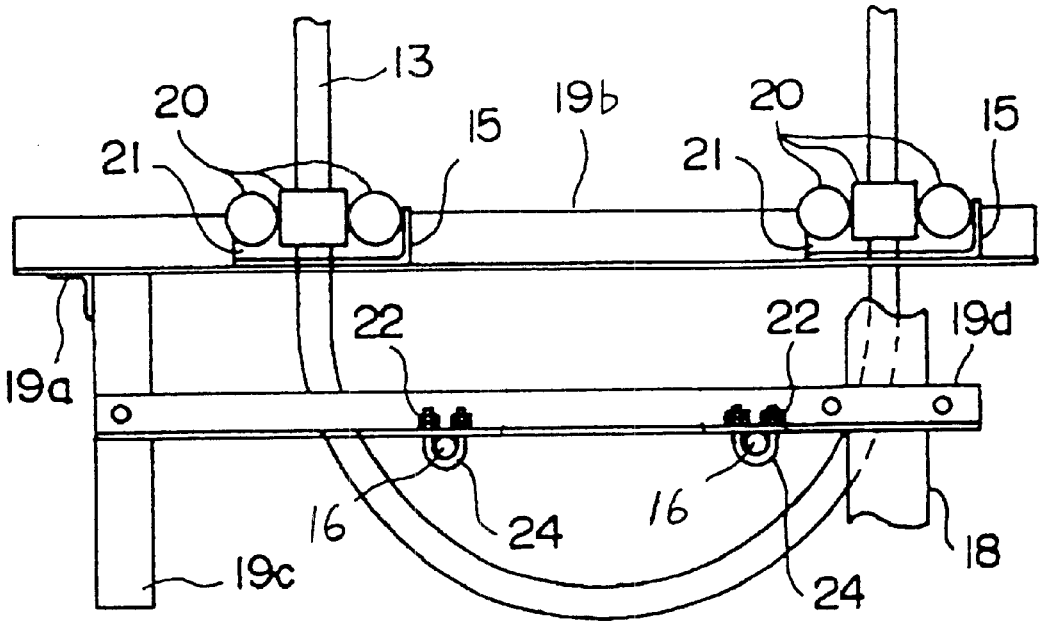
FIG. 2 is a side view of first guide and second guide of the first embodiment.
Figure 3:
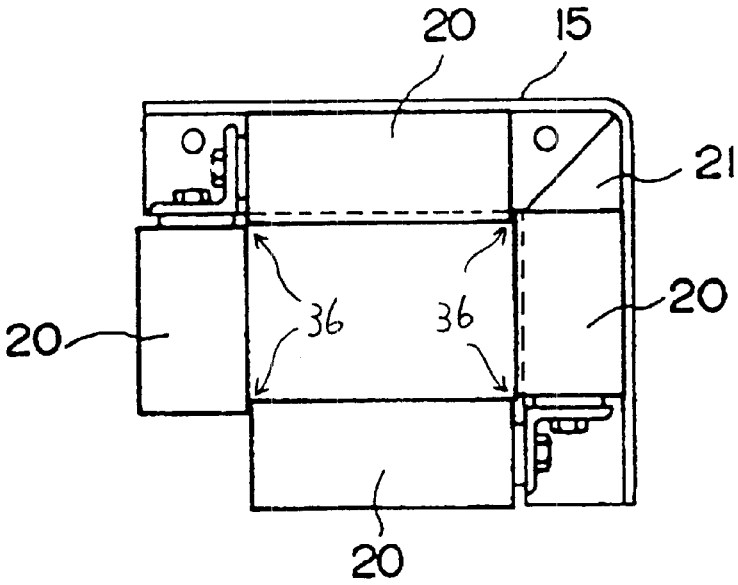
FIG. 3 is a plan view of rotatable member of the first embodiment.

FIG. 2 is a side view of the first guide 33 and the second guide 34 of the first embodiment shown in FIG. 1. FIG. 3 is a plan view of one of the rotatable members 15 of the first embodiment.

As shown in FIG. 2 and FIG. 3, each of the rotatable members 15 is composed of four cylindrical rollers 20 supported by an angle bracket 21 and fixed to the bracket 19*b*. The bars 16 are fixed to the bracket 19*d* with U-shaped bolts 24 and nuts 22.

Each surface of cylindrical rollers 20 is composed of a low friction member having low frictional property against a surface of the compensating ropes 35. Urethane rubber, Bakelite, Aluminum alloy and Nylon are appropriate for the low friction member, and Polyethylene is also available.

According to this traction elevator, the first guide 33 guides the first linear portions 31 and the second linear portions 32 of the compensating ropes 35 and the second guide 34 guides the curving portions 30 of the compensating ropes 35. Accordingly, even if the compensating ropes 35 swing and seem to shift over the first guide 33, the second guide 34 prevents the compensating ropes 35 from moving over the first guide 33. As a result, there is no possibility of the compensating ropes 35 swaying seriously, and the comfort of the ride in the car 1 is not influenced. Further, this traction elevator stops the emission of unpleasant noise and vibration of the car 1 and provides a pleasant environment for residents and passengers.

Furthermore, since the surfaces of the cylindrical rollers 20 are composed of low friction member having low frictional properties against the surfaces of the compensating ropes 35, the compensating ropes 35 are not caught in any of the corners 36 of the cylindrical rollers 20.

Figure 4:
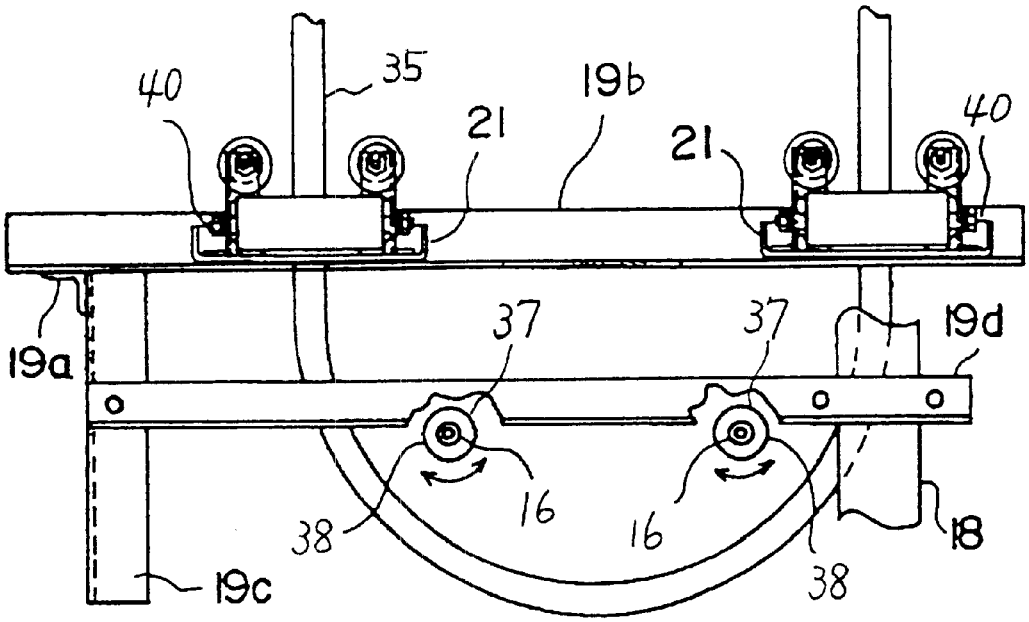
FIG. 4 is a side view of a compensating rope guide of a second embodiment of the present invention.

FIG. 4 is a side view of the compensating rope guide of a second embodiment of the present invention. In the following description, only components different from components explained in the first embodiment are described. In this embodiment, the first guide 33 and the second guide 34 in the first embodiment are modified. The rotatable member 15 in FIG. 2 is substituted by a rotatable member 40. The first guide is composed of four rotatable members 40 shown in FIG. 6. Each of rotatable member 40 is composed of four cylindrical rollers 20 supported by the angle bracket 21 like the rotatable member 15 in FIG. 3. Each cylindrical roller 20 forms one side of a quadrilateral, and the two facing pairs of the cylindrical rollers 20 mutually intersect. One facing pair of the cylindrical rollers 20 is located above the other. The second guide 34 is composed of two second rotatable members 37 fixed to the bracket 19*d* so that the compensating ropes 35 are directed in the direction in which they are moving. Each of the second rotatable members 37 consists of the bar 16 and a cylindrical cover 38 rotatably covering a surface of the bar 16.

The second rotatable members 37 are arranged to contact and guide the compensating ropes 35 when the compensating ropes 35 swing by a predetermined distance from their stationary position.

According to this embodiment, since the two pair of cylindrical rollers 20 which mutually intersect are placed one above the other, if the compensating ropes 35 hit a corner of the cylindrical rollers 20, the compensating ropes 35 are not caught in the corner. As a result, the rotation of the cylindrical rollers 20 does not become difficult and the compensating ropes 35 do not negatively influence the comfort of the ride in the car 1.

Figure 5:
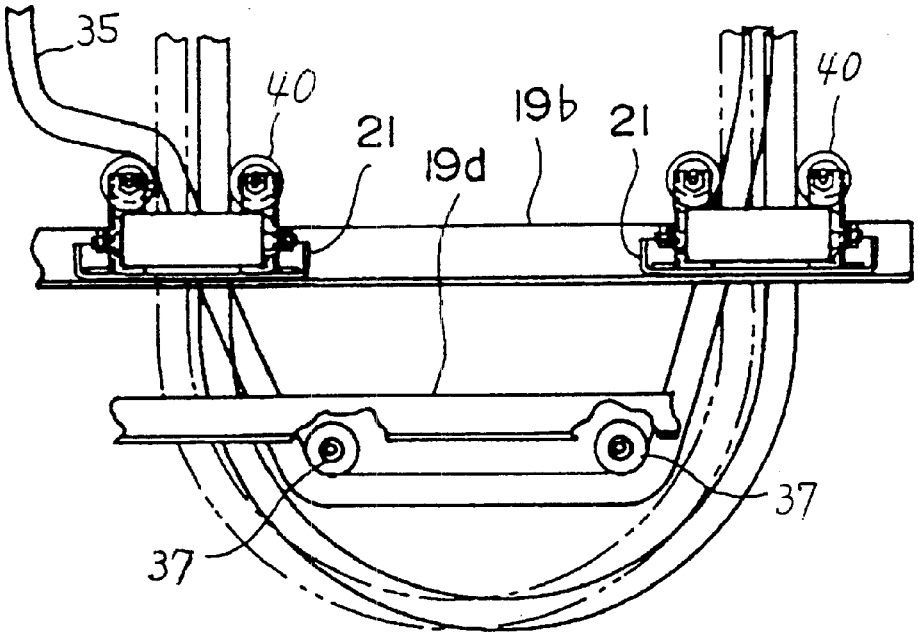
FIG. 5 is an illustrative diagram showing an example of the operation of compensating rope in FIG. 4.

Further, since the second guide 34 is composed of the second rotatable members 37 so that the compensating ropes 35 are directed in the direction in which they are moving, when a building sways due to a sudden gust of wind or an earthquake and the compensating ropes 35 contact the second rotatable members 37, the second rotatable members 37 rotate so as to attenuate the friction between the second guide 34 and the compensating ropes 35 and to prevent the compensating ropes 35 from being damaged. Further, since the second rotatable members 37 are arranged to contact and guide the compensating ropes 35 when the compensating ropes 35 swing by a predetermined distance, the compensating ropes 35 do not contact the second rotatable members 37 in normal operation, except that the compensating ropes 35 swing a large distance due to a sudden gust of wind or an earthquake. Consequently, in normal operation, no unpleasant noise is caused by interference between the compensating ropes 35 and the second rotatable members 37. Further, as shown in FIG. 5, even if the compensating ropes 35 seem to get over the first guide 33 due to a big swing, the second guide 34 restricts that motion of the compensating ropes 35 and prevent the compensating ropes 35 from being pressed against the angle bracket 21 of the first guide 33 at acute angle and from being damaged.

Figure 7:
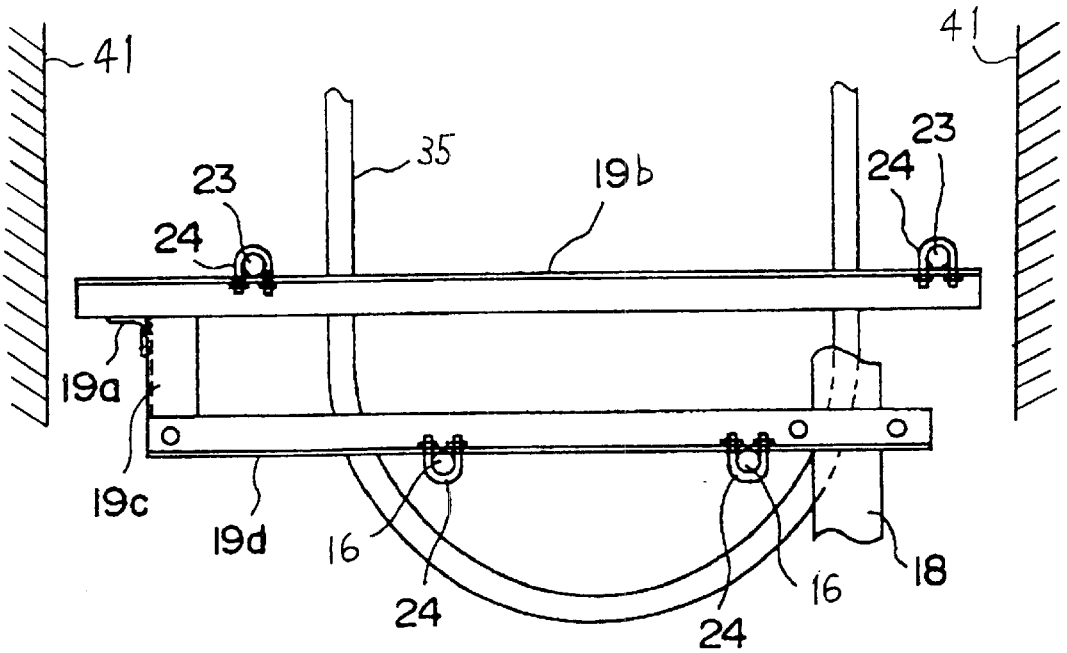
FIG. 7 is a side view of a compensating rope guide of a third embodiment of the present invention.

FIG. 7 is a side view of a compensating rope guide of a third embodiment. In the following description, only components different from the components explained in the first embodiment are described.

In this embodiment, bars 23 are substituted for the rotatable members 15 in FIG. 2. The bars 23 are respectively arranged at the wall 41 sides of the elevator shaft 4 on either side of the compensating ropes 35 and fixed to brackets 19*b* with U-shaped bolts 24 and nuts.

According to this embodiment, since the first guide 33 is composed of the bars 23 respectively arranged at the wall 41 sides of the elevator shaft 4 on either side of the compensating ropes 35 and the second guide 34 is composed of the bars 16, the bars 23 restrict the swing of the compensating ropes 35 and the bars 16 prevent the compensating ropes 35 from getting over the bars 23 of the first guide 33. As a result, the compensating ropes 35 do not swing by a large distance and have no influence on the comfort of the ride in the car 1. Further, this embodiment reduces the cost of the compensating rope guide and provides an inexpensive elevator.

Figure 8:
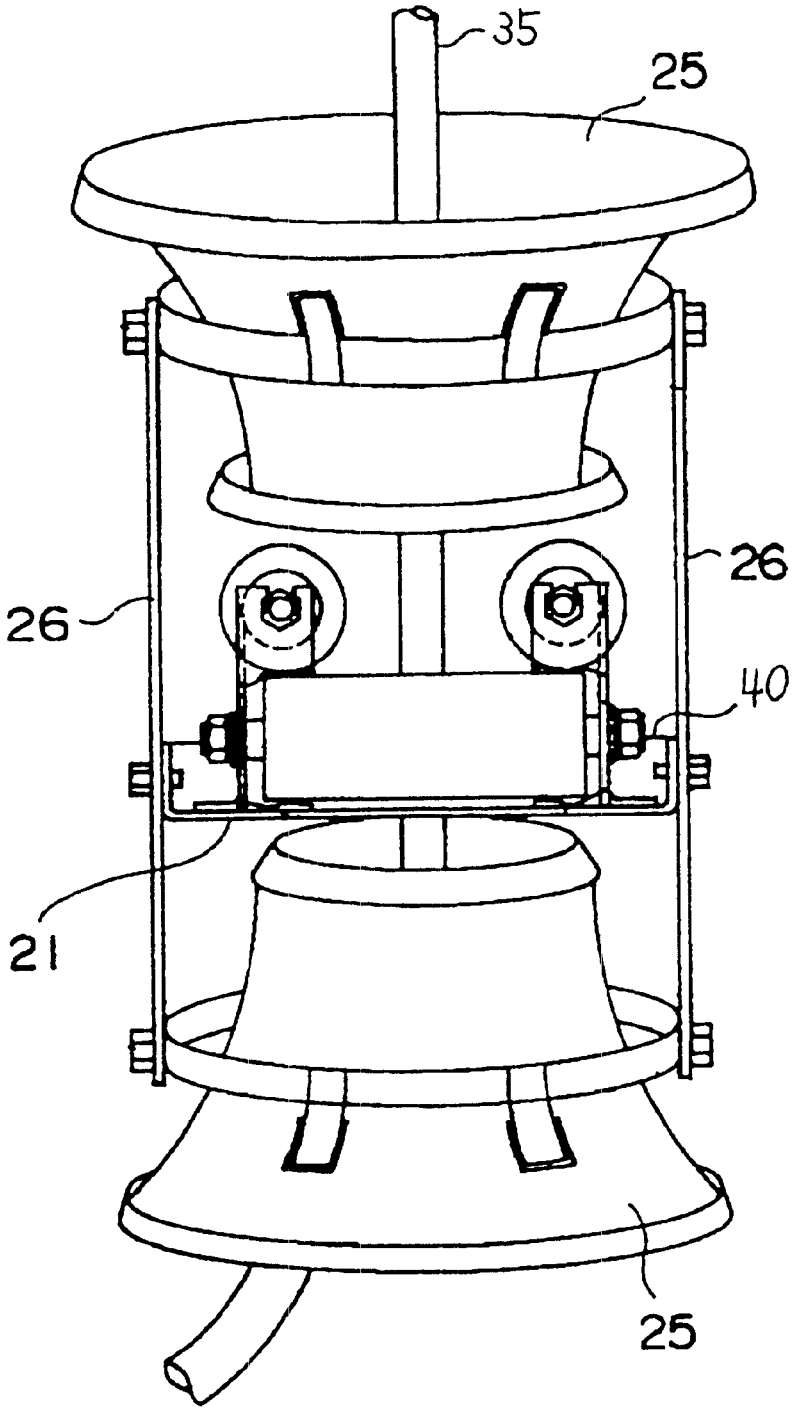
FIG. 8 is a side view of a compensating rope guide of a fourth embodiment of the present invention.

FIG. 8 is a side view of a compensating rope guide of a fifth embodiment of the present invention. In the following description, only components different from the components explained in the first embodiment are described.

Figure 6:
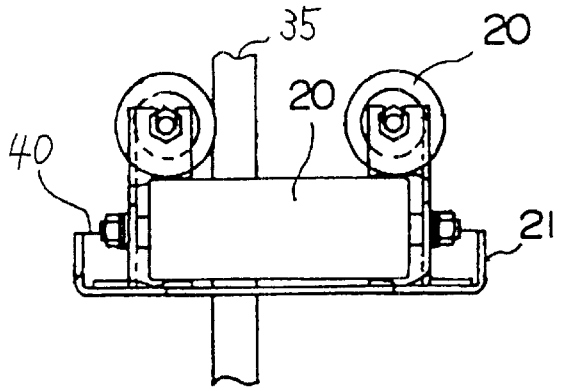
FIG. 6 is a side view of a rotatable member of compensating rope guide of a second embodiment of the present invention.

The rotatable member 40 in the third embodiment shown in FIG. 6 is applied to the rotatable member 15 in FIG. 2. In the fifth embodiment, the second guide 34 in FIG. 2 is omitted and two bell-shaped guides 25 are attached to both the upper and lower sides of the rotatable member 40 of the first guide 33 guiding linear portions of the compensating ropes 35. The bell-shaped guides 25 are fixed to the rotatable member 40 with support member 26.

According to this embodiment, the bell-shaped guides 25 keep the orbit of the compensating ropes 35 secure and prevent the compensating ropes 35 from being pushed against the angle bracket 21 at an acute angle, and from making unpleasant noise.

Figure 9:
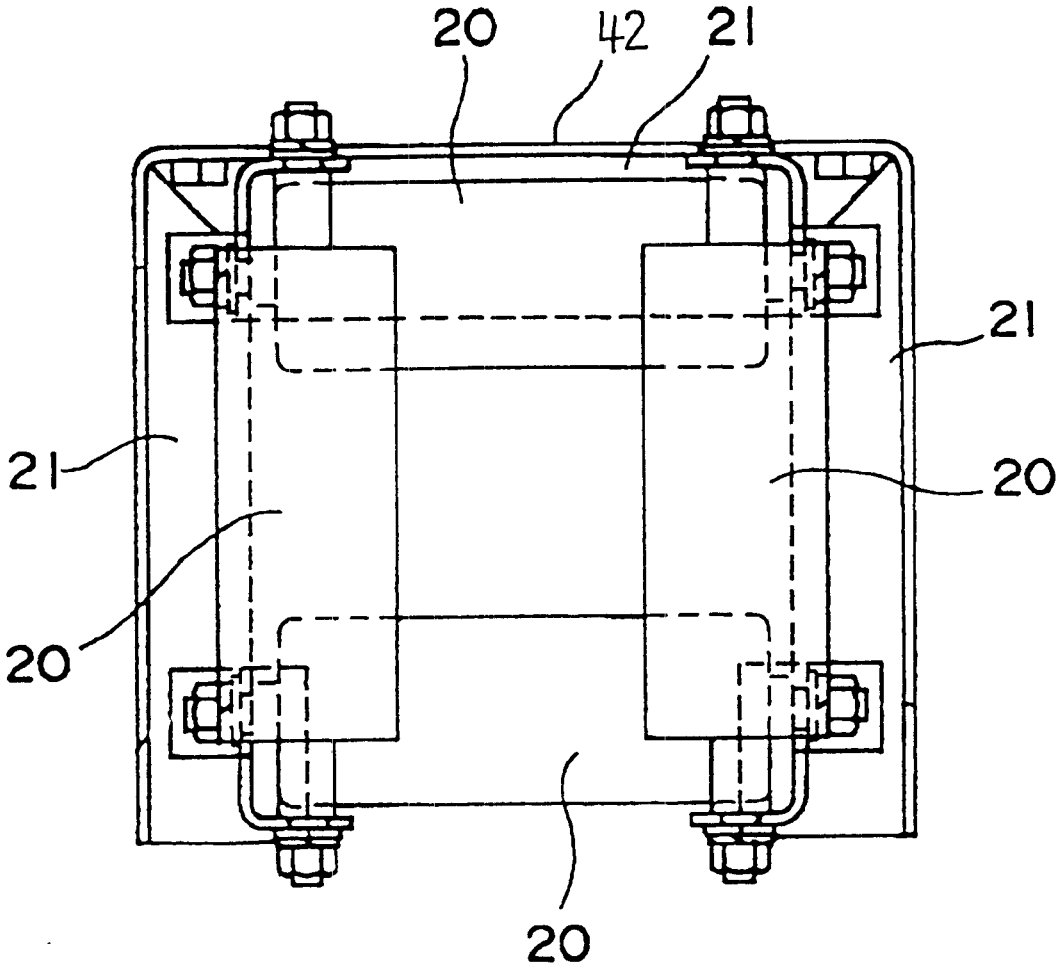
FIG. 9 is a side view of a rotatable member of compensating rope guide of a fifth embodiment of the present invention.

FIG. 9 is a side view of one of the rotatable members of the compensating rope guide of a sixth embodiment. In the following description, only components different from the components explained in the first embodiment are described. The rotatable member is applied to the rotatable member 15 in FIG. 2. In this embodiment, rotatable member 42 is composed of four cylindrical rollers 20 supported by the angle bracket 21 like the rotatable member 15. Each cylindrical roller 20 forms one side of a quadrilateral and the two facing pairs of cylindrical rollers 20 mutually intersect. One pair of cylindrical rollers 20 is placed above the other. Further, the edges of one pair of the cylindrical rollers 20 overlap inside a horizontally projected plane of the other pair of the cylindrical rollers 20.

According to this embodiment, since the edges of one pair of the cylindrical rollers 20 overlap inside a horizontally projected plane of the other pair of the cylindrical rollers 20, the compensating ropes 35 are not caught in a corner of the cylindrical rollers 20. As a result, the rotation of the cylindrical rollers 20 does not become difficult and the compensating ropes 35 have no influence on the comfort of the ride in the car 1.

Figures 10A, 10B:
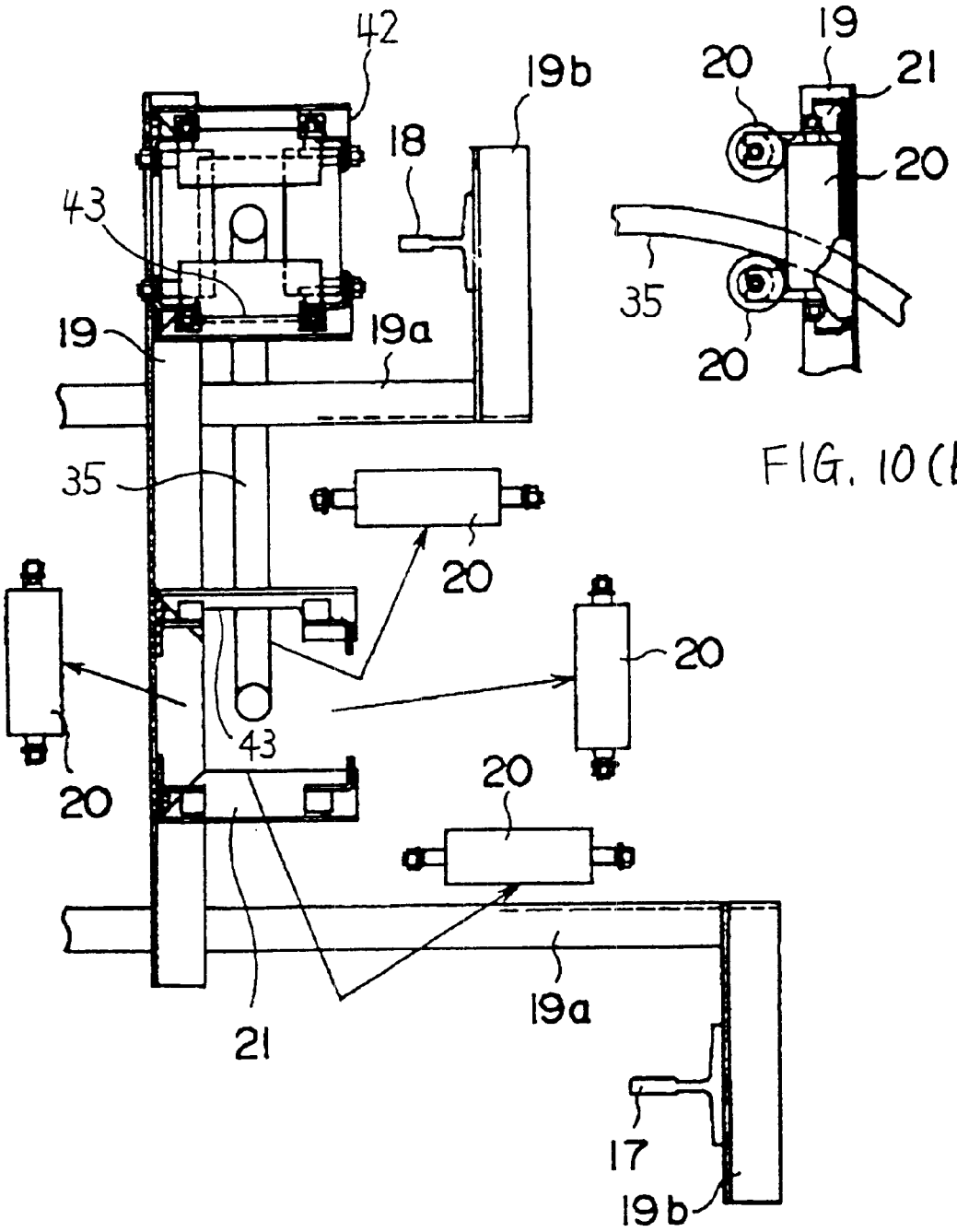
FIG. 10(*a*) is a plan view of a rotatable member of a compensating rope guide of a sixth embodiment of the present invention.
Figure 11:
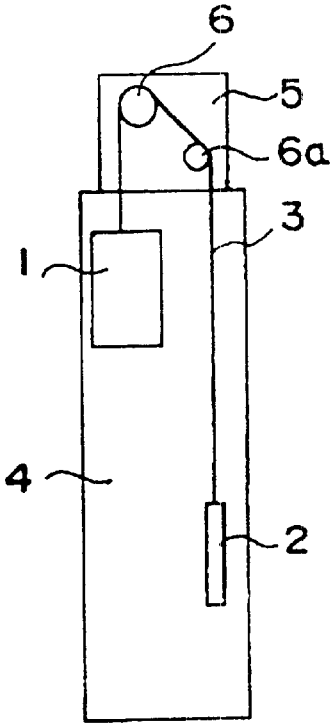
FIG. 11 (a) (PRIOR ART)
FIGS. 11(*a*) and 11(*b*) are side views of ordinary types of traction elevators which have been widely used.
Figure 11:
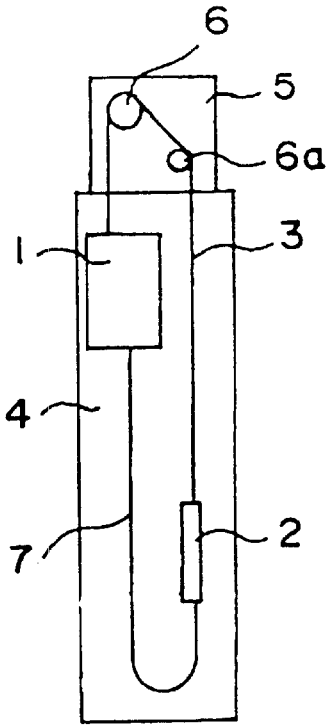
FIG. 11 (b) (PRIOR ART)

FIG. 10 (*a*) is a plan view of a pair of rotatable members of a compensating rope guide of a seventh embodiment. FIG. 10(*b*) is a side view of one of the rotatable members of the compensating rope guide of the seventh embodiment. In the following description, only components different from components explained in the first embodiment are described. The rotatable member is applied to the rotatable member 15 in FIG. 2. In this embodiment, rotatable member 42 is composed of four cylindrical rollers 20 supported by the angle bracket 21 with a cut 43 corresponding to the path of the compensating ropes 35. Each of the cylindrical rollers 20 forms one side of a quadrilateral and the two facing pairs of cylindrical rollers 20 mutually intersect. One pair of cylindrical rollers 20 is placed above the other. Further, the edges of one pair of the cylindrical rollers 20 overlap inside a horizontally projected plane of the other pair of the cylindrical rollers 20.

According to this embodiment, since the cylindrical rollers 20 are supported by the angle bracket 21 with a cut 43 corresponding to the path of the compensating ropes 35, if the compensating ropes 35 are pushed to the cylindrical rollers 20 due to a big swing, the compensating ropes 35 merely contact the angle bracket 21. As a result, the compensating ropes 35 do not make unpleasant noise.

In the above embodiments, one second guide 34 is arranged in the pit 12, but more than two second guides 34 placed one above the other may be arranged below the first guide 33.

According to this invention, it is possible to provide a traction elevator having a compensating rope guide which can reduce the swing of a compensating rope so as to stop the emission of unpleasant noise and vibration of an elevator car, and thus not negatively influence the comfort of the ride in the car.

What is claimed is:

1. An elevator having a rope having a first end connected to a top of a car and a second end connected to a top of a counterweight, and the rope being guided and driven by a sheave that is rotated by a motor, comprising:

a compensating rope suspended from said car to said counterweight, said compensating rope having a curving portion, a first linear portion on a car side of said curving portion and a second linear portion on a counterweight side of said curving portion;

a first guide arranged to guide said first linear portion and said second linear portion;

a pair of second guides arranged below said first guide and positioned horizontally spaced apart between vertical lines extending from said first linear portion and said second linear portion for guiding said curving portion; and a frame arranged in an elevator shaft for supporting said first guide and said second pair of guides;

wherein said pair of second guides is spaced apart by a distance equal to at least half of a distance between inner guiding surfaces of said first guides.

2. The elevator as recited in claim 1, wherein:

said first guide comprises a rotatable member for directing said compensating rope in the direction in which it is moving.

3. The elevator as recited in claim 1 or claim 2, wherein:

said second guide comprises at least one bar.

4. The elevator as recited in claim 1, wherein:

said second guide contacts and guides said compensating rope at the time said compensating rope swings a predetermined distance.

5. The elevator as recited in claim 2, wherein:

said rotatable member comprises cylindrical rollers.

6. The elevator as recited in claim 1 or claim 2, wherein:

said pair of second guides comprises a second rotatable member for directing said compensating rope in the direction in which it is moving.

7. The elevator as recited in claim 1, wherein:

said first guide comprises a plurality of bars arranged at a wall side of an elevator shaft away from said compensating rope.

8. The elevator as recited in claim 3, wherein:

said cylindrical rollers include two pairs of cylindrical rollers that mutually intersect, said two pairs of cylindrical rollers being positioned one above the other.

9. The elevator as recited in claim 3, wherein:

at least two of said cylindrical rollers are supported by an angle bracket with a cut corresponding to a path of said compensating rope.

10. The elevator as recited in claim 1, further comprising:

a cylindrical cover rotatably covering a surface of said bar.

11. The elevator as recited in claim 6, wherein:

the ends of one pair of rollers of said two pairs of rollers are arranged inside of a horizontally projected plane of the other pair of rollers.

* * * * *